United States Patent [19]

Pearson

[11] 4,366,660

[45] Jan. 4, 1983

[54] CORNERBEAD AND CORNER CLIP

[75] Inventor: Robert J. Pearson, Tonawanda, N.Y.

[73] Assignee: National Gypsum Company, Dallas, Tex.

[21] Appl. No.: 319,571

[22] Filed: Nov. 9, 1981

Related U.S. Application Data

[62] Division of Ser. No. 66,625, Aug. 15, 1979, abandoned.

[51] Int. Cl.[3] ..... E04B 1/00

[52] U.S. Cl. ..... 52/741; 52/712; 29/413

[58] Field of Search ..... 52/741, 212, 715; 72/329; 29/412, 413

[56] References Cited

U.S. PATENT DOCUMENTS

| | | | |
|---|---|---|---|
| 2,351,525 | 6/1944 | Leary | 52/712 X |
| 2,423,863 | 7/1947 | Wales | 72/339 X |
| 3,210,898 | 10/1965 | Kurtz | 52/715 X |
| 3,741,068 | 6/1973 | Andruskiewicz | 52/712 X |
| 3,881,293 | 5/1975 | Conville | 52/712 |

*Primary Examiner*—Price C. Faw, Jr.
*Assistant Examiner*—Carl D. Friedman
*Attorney, Agent, or Firm*—Robert F. Hause

[57] ABSTRACT

An elongate formed and punched sheet metal cornerbead, for use on outside corners, adapted to be easily cut into individual wallboard corner clips, for use on inside corners.

4 Claims, 4 Drawing Figures

CORNERBEAD AND CORNER CLIP

This application is a division of copending application Ser. No. 066,625, filed Aug. 15, 1979, now abandoned.

This invention relates to an elongate cornerbead, and particularly to a cornerbead having performations which permit rapid severance into a plurality of individual wallboard corner clips.

U.S. Pat. No. 3,008,273 discloses an elongate cornerbead which is formed with one of its two flanges slit perpendicular to the edge at repeated positions, to permit the cornerbead to be deformed into an arc to be used on the lower corners of an archway.

U.S. Pat. No. 3,255,561 discloses an elongate cornerbead which is formed with holes along the inner edge of each flange for keying to the joint compound, holes along the outer edge of each flange for nailing, and elongated slots in between, parallel to the lengthwise direction of the cornerbead, for providing improved bonding of the joint compound to the flange.

U.S. Pat. No. 3,323,264 discloses an elongate cornerbead having a bendable tab on one flange, whereby the cornerbead can be supported in position by a wallboard edge which is gripped between the bent tab and the opposite flange.

The present invention relates to an elongate cornerbead which is adapted to be readily converted into a plurality of wallboard corner clips.

It is an object of this present invention to provide an improved cornerbead, in that corner clips can be readily cut from sections or waste portions of the cornerbead.

These and other objects of the invention will be readily apparent when considered in relation to the preferred embodiments as set forth in the specification and shown in the drawings in which.

Figure 1:
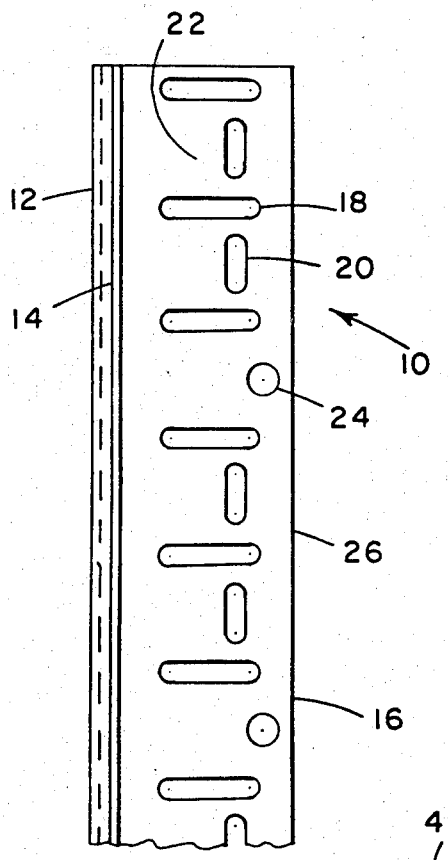
FIG. 1 is a side view of the cornerbead of the present invention.
Figure 2:
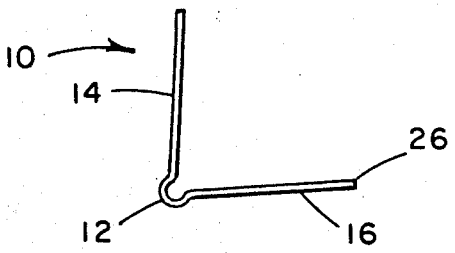
FIG. 2 is an end view of the cornerbead of FIG. 1.
Figure 3:
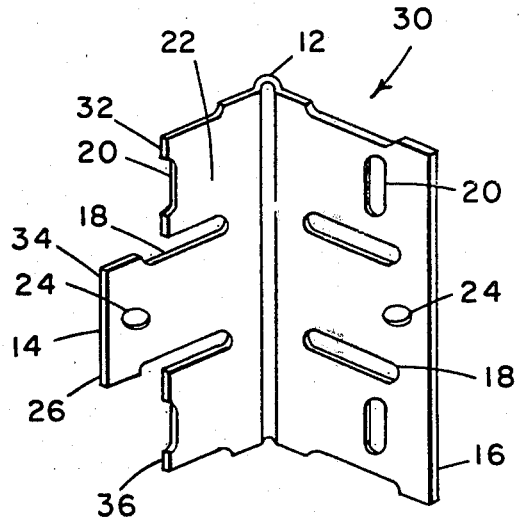
FIG. 3 is an isometric view of a segment of the cornerbead of FIG. 1, prior to being formed into a corner clip.

Referring to FIGS. 1 and 2, there is shown an elongate formed sheet metal cornerbead 10. Cornerbead 10 is formed of hot dip galvanized steel of about 0.013" to 0.020" thickness.

Cornerbead 10 includes a central small bead section 12 and two outwardly extending flanges 14, 16, disposed at an angle of about 80° one to the other. Each flange 14, 16 has a plurality of laterally extending slots 18 and a plurality of longitudinally extending slots 20. It is not essential that both flanges include the slots 18 and 20, but only that one flange necessarily has them.

The laterally extending slots 18 are substantially evenly spaced at about $\frac{3}{4}$ inch spacings throughout the length of the cornerbead 10. The longitudinally extending slots 20 are about $\frac{3}{8}$ inch long and are centered longitudinally between laterally extending slots 18 in two out of each three spaces 22 formed between the slots 18.

In each space 22 in which there is no slot 20, there is a nail hole 24 located close to the outer edge 26 of each flange 14, 16.

Flanges 14, 16 are preferably about $1\frac{1}{8}$ inches wide, excluding the bead section 12. Bead section 12 has a diameter of about $\frac{1}{8}$ inch, making the outside dimension of cornerbead 10 about $1\frac{1}{4}$ inches. Lateral slots 18 are $\frac{1}{8}$ inch by 11/16 inch and are spaced $\frac{1}{8}$ in from edge 26. Longitudinal slots 20 are $\frac{1}{8}$ inch by $\frac{3}{8}$ inch and are spaced 5/16 inch in from edge 26. Holes 24 are 3/16 inch diameter and are centered 3/16 inch in from edge 26.

Cornerbead 10 is adapted to be used as the exterior wear surface of a wall outside corner in accordance with well-known construction techniques.

In accordance with the invention, cornerbead 10, preferably a scrap section thereof, is adapted to be cut to a length of $2\frac{1}{4}$ inches, for use as a corner clip 30. The cornerbead is completely severed at the center of a lateral slot 18, preferably the lateral slots which are disposed between two spaces 22 containing longitudinal slots 20.

After severing the cornerbead 10 into a $2\frac{1}{4}$ inch section, the portion of flange 14 between edge 26 and the two lateral slots 18, 18 is severed, leaving three separate tabs 32, 34, 36. Tab 32 and tab 36, the outer two, each have a longitudinal slot 20 when first severed into individual tabs, and in the preferred form of the invention, the corner clip 30 has that portion of tab 32 and tab 36 outward of longitudinal slots 20 removed.

Corner clip 30 is now adapted to be used to hold one edge 38 of a wallboard 40, in the construction of an inside corner from two wallboards 40, 42. The corner clip 30 can be, first, nailed in place, through nail hole 24 in tab 34, on a framing member 44 which has a surface intended to be abutting the edge 38 surface of wallboard 40, and, second, wallboard 40 can then be placed against the flange 16 thereof, followed by the bending of tabs 32 and 36 to form a channel, holding wallboard edge 38.

Alternatively, the corner clip 30 can be, first, placed on the wallboard edge 38 with tabs 32 and 36 bent to grasp the wallboard edge 38, followed by placing the wallboard 40 in place and then nailing the corner clip 30 to the framing member 44.

A corner clip could be made in which one of the two tabs 32, 36 is omitted.

Figure 4:
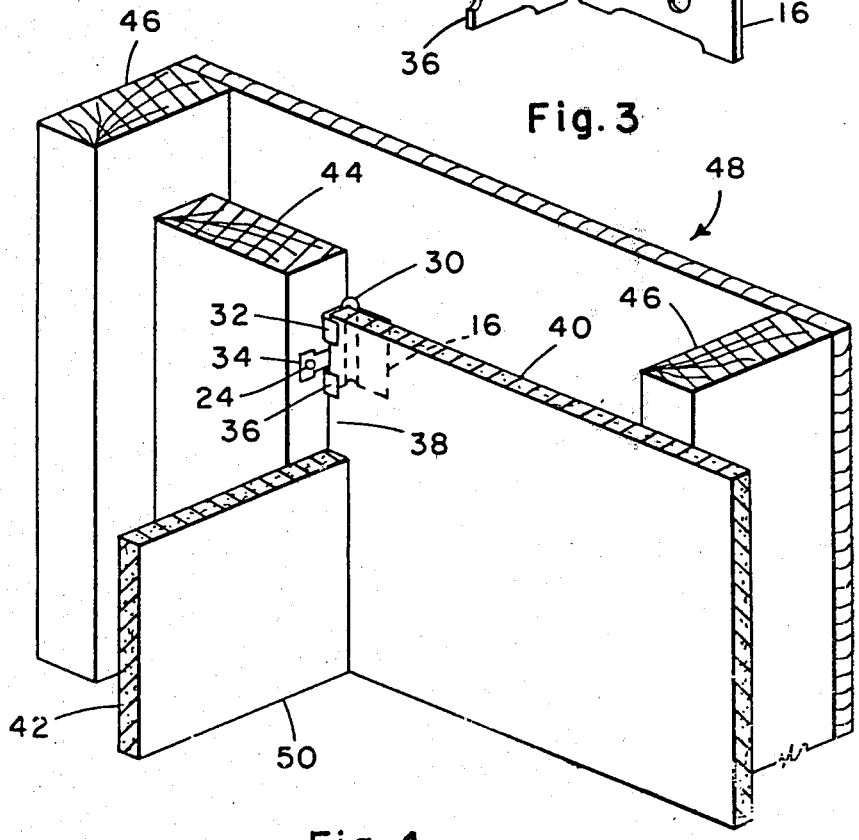
FIG. 4 is an isometric view of an inside corner of a wall showing the novel corner clip holding the vertical edge of a wallboard.

FIG. 4 also includes two additional framing members 46, 46, placed apart 16 inches on center. Framing members 46, 46 are two of several such framing members for forming a wall 48. Framing member 44 is disposed in a perpendicular arrangement to the dispositions of framing members 46, 46, and is the first of several such framing members for forming intersecting wall 50.

The use of corner clips 30 for holding wallboard edge 38 eliminates the need for a framing member behind the edge 38. This is particularly advantageous in joining an intersecting wall 50 to a wall 48 which is an outside wall. Whenever the disposition of framing members 46 in an outside wall are altered from the regular 16-inch spacing, it interferes with the ability to properly place insulation in the walls as best possible.

Having completed a detailed disclosure of the preferred embodiments of my invention, so that others may practice the same, I contemplate that variations may be made without departing from the essence of the invention.

I claim:

1. The method of forming a corner clip comprising the steps of severing a cornerbead comprising an elongate straight formed sheet of metal adapted to be easily cut into a plurality of sheet metal clips, said cornerbead consisting essentially of a bead section and two opposed flat flanges disposed at about an 80° angle therebetween, at least one of said flanges having a plurality of substantially uniformly repetitive openings, said openings including a plurality of elongate slots adapted for simplifying the making of preplanned cuts for converting portions of said cornerbead into short corner clips, said slots including a repetitive pattern of laterally extending slots, said laterally extending slots being spaced outward from said bead section and inward from the outer edge of said flange, said outer edge being uninterrupted throughout the length of said corner bead, severing said cornerbead to form a short section thereof by completely severing said cornerbead at a pair of locations which are at lateral slots which have at least one lateral slot therebetween, severing the portion of said flange between one or more of said in between-slots and the outer edge of said flange adjacent said one or more slots, thus forming a plurality of separated tabs, and bending at least one but not all of said tabs to form a channel for receiving a wallboard edge and leaving at least one unbent tab for nailing said clip to a framing member.

2. The method of claim 1 wherein said tabs to be bent have a longitudinal slot, and wherein said tabs are shortened by severing said tabs along said longitudinal slot.

3. The method of forming a corner clip comprising the steps of severing a cornerbead as defined in claim 1, said cornerbead having a repetitive pattern of longitudinally extending slots disposed between at least some of said laterally extending slots and said longitudinal slots being repetitiously disposed in two of every three spaces between said lateral slots completely severing said cornerbead at a pair of locations which are at lateral slots having a longitudinal slot on each side thereof, severing the portion of said flange between the edge of said flange and the two lateral slots between the ends of the clip, thus forming three separated tabs, and bending the two outermost tabs to form a channel for receiving a wallboard edge, leaving one unbent tab therebetween for affixation to a framing member.

4. The method of constructing two intersecting walls comprising the steps of disposing a plurality of aligned vertical framing members at uniform spaces to support a first wall, disposing a framing member for starting an intersecting wall adjacent to, but not within the alignment of, the aligned first wall framing members, forming a corner clip by the method of claim 1, and affixing the wallboard of said first wall, which wallboard abuts the wallboard of said intersecting wall, by placing said corner clip on said wallboard edge and fastening a tab of said corner clip to said intersecting wall framing member.

* * * * *